US006893516B2

(12) United States Patent
Rudolf

(10) Patent No.: US 6,893,516 B2
(45) Date of Patent: May 17, 2005

(54) INSENSITIVE PRESSABLE EXPLOSIVE

(75) Inventor: Karl Rudolf, Schrobenhausen (DE)

(73) Assignee: Diehl Munitionssysteme GmbH & Co. KG, Rothenbach (DE)

( * ) Notice: Subject to any disclaimer, the term of this patent is extended or adjusted under 35 U.S.C. 154(b) by 160 days.

(21) Appl. No.: 10/264,019

(22) Filed: Oct. 3, 2002

(65) Prior Publication Data

US 2003/0127166 A1 Jul. 10, 2003

(30) Foreign Application Priority Data

Nov. 14, 2001 (DE) ..... 101 55 885

(51) Int. Cl.[7] ..... C06B 45/10; C06B 45/22; C06B 25/34

(52) U.S. Cl. ..... 149/19.91; 149/11; 149/19.2; 149/92

(58) Field of Search ..... 149/92, 109.6, 149/19.2, 3, 19.91, 2, 9, 11, 105; 264/3.1, 3.2

(56) References Cited

U.S. PATENT DOCUMENTS

| | | | | |
|---|---|---|---|---|
| 2,102,372 A | | 12/1937 | Mills | |
| 3,984,264 A | | 10/1976 | Lampert | |
| 4,794,180 A | | 12/1988 | Heinemeyer et al. | |
| 5,183,520 A | | 2/1993 | Wanninger et al. | |
| 5,547,527 A | * | 8/1996 | Muller et al. | 149/19.92 |
| 5,750,921 A | * | 5/1998 | Chan et al. | 149/19.92 |

FOREIGN PATENT DOCUMENTS

| | | |
|---|---|---|
| DE | 40 06 961 A1 | 9/1991 |
| DE | 41 26 981 C1 | 1/1993 |
| DE | 197 19 073 A1 | 11/1998 |
| EP | 509 200 B1 | 10/1992 |

* cited by examiner

*Primary Examiner*—Aileen B. Felton
(74) *Attorney, Agent, or Firm*—Scully, Scott, Murphy & Presser

(57) ABSTRACT

An insensitive pressable explosive with a high level of energy comprises octogen grains or hexogen which are coated with a polysiloxane solution.

4 Claims, No Drawings

INSENSITIVE PRESSABLE EXPLOSIVE

BACKGROUND OF THE INVENTION

1. Field of the Invention

The invention relates to an insenstive, pressable and castable explosive and a process for the production of said explosive.

2. Discussion of the Prior Art

The invention is based on a phlegmatised explosive, corresponding to EP 0 509 200 B1 and DE 40 06 961. This involves explosive mixtures in which the particulate explosive is coated with a phlegmatising inert binder. Improved insensitivity is achieved with those binders. In the meantime the demands in respect of insensitivity have been set at a markedly higher level. Those demands are not attained by the known binders.

SUMMARY OF THE INVENTION

The object of the invention is to propose a high-energy, insensitive pressable explosive.

The invention attains that object in providing an explosive which comprises:

| | |
|---|---|
| octogen or hexogen | 92–97% by weight |
| DOA | 1–6% by weight |
| Hy Temp | 0.5–2% by weight and |
| polysiloxanes | 1–5%; and which is produced by a process as described hereinbelow. |

DETAILED DESCRIPTION OF PREFERRED EMBODIMENTS

The invention advantageously provides that an at least monomolecular layer is applied to the crystals of the explosive and fills surface flaws. That eliminates very fine pores which otherwise act as so-called hot spots, with the effect that the explosive reacts in an unwanted fashion when subjected to a relatively low level of loading. The complete wetting effect provides that a high-energy explosive already achieves virtually a 100% theoretical density with just a low inert proportion. As a result, because of the virtually zero porosity of the explosive charge, this affords a further enhanced level of insensitivity with an increased degree of efficiency. This explosive is suitable for shaped charges and fragmentation charges.

An explosive having the following composition:

| | | |
|---|---|---|
| octogen (HMX) | 96% | 70% Class 3, grain size <500 μm<br>30% Class 2 |
| DOA | 3% | |
| Hy Temp | 1% | |
| xpolysiloxane, rain'x ® | 1°/00 | |

-continued

DOA is the abbreviation for dioctyl adipate and serves as a plasticiser.
Hy Temp is a trade mark of ZEON Chemicals L.P., 4111 Bells Lane, Louisville, Kentucky 40211, and belongs to the chemical family of polyacrylic polymers.
rain'x ® is a mark of Unelko Corporation in the USA.

There are three suitable alkyl polysiloxanes, namely dimethyl polysiloxanes methyl hydrogen polysiloxanes, and methylphenyl polysiloxanes.

1. The production process comprises the following steps:

Octogen in an amount of 70 parts of coarse grain is mixed with 30 parts of fine grain in a container.

2. A polyalkylsiloxane solution is diluted with isopropanol in a ratio by volume of 1:6, added to the explosive mixture and stirred until complete wetting has taken place.

3. The mixture is dried.

4. In a suction filtration apparatus the slurry is washed 3 to 4 times with distilled water and sucked away as far as possible.

5. The mixture is dried.

6. In parallel therewith a solution is made up from 1 part of Hy Temp and 3 parts of DOA in 25 parts of solvent mixture comprising 60% ethanol, 20% acetic acid ethyl ester and 20% acetone.

7. The dried, pretreated explosive mixture is added to the prepared binder solution in a Drais mixer and mixed at 40° C. for about 1–2 hours with same at a medium agitation speed (rotary speed 60/min).

8. The solvent is completely removed with continuing agitation under a pump vacuum, duration about 2 to 3 hours, wherein finally a dry pressable granular material with an approximately 1 to 2 mm particle diameter is produced.

The production process is to be carried out in an equivalent fashion, on the basis of hexogen.

What is claimed is:

1. An insensitive pressable explosive comprising an explosive component and a binder component, wherein said explosive component comprises 92–97% by weight octogen or hexogen and 1–5% by weight polysiloxanes; and the binder component comprises 1 part polyacrylic elastomer and 3 parts DOA in 25 parts of solvent mixture comprising 60% of ethanol, 20% of acetic acid ethyl ester and 20% of acetone.

2. An explosive according to claim 1 characterised in that the octogen or hexogen comprises 70% by weight of coarse grain and 30% by weight of fine gain.

3. An explosive according to claim 2 characterised in that the grains of the octogen or hexogen are wetted with polysiloxane.

4. An explosive according to claim 1 characterised in that the binder component proportion is 2–8% by weight.

* * * * *